US012680288B2

(12) United States Patent
Frank

(10) Patent No.: US 12,680,288 B2
(45) Date of Patent: Jul. 14, 2026

(54) METHOD FOR INTERCONNECTING FLOOR DRAINS

(71) Applicant: Keith Frank, Hesperus, CO (US)

(72) Inventor: Keith Frank, Hesperus, CO (US)

( * ) Notice: Subject to any disclaimer, the term of this patent is extended or adjusted under 35 U.S.C. 154(b) by 113 days.

(21) Appl. No.: 17/711,737

(22) Filed: Apr. 1, 2022

(65) Prior Publication Data

US 2022/0333366 A1 Oct. 20, 2022

Related U.S. Application Data

(60) Provisional application No. 63/175,250, filed on Apr. 15, 2021.

(51) Int. Cl.
*E03F 5/04* (2006.01)

(52) U.S. Cl.
CPC ..... *E03F 5/041* (2013.01); *E03F 5/0407* (2013.01)

(58) Field of Classification Search
CPC ..... E03F 5/041; E03F 5/0407; E03F 5/0408; E03F 2005/0413; E03F 2005/0414
USPC ..... 4/252.1, 252.2, 428, 613, 679, 695, 4/DIG. 7, DIG. 9
See application file for complete search history.

(56) References Cited

U.S. PATENT DOCUMENTS

| | | | | |
|---|---|---|---|---|
| 982,836 | A | 1/1911 | Ley et al. | |
| 5,819,326 | A | 10/1998 | Kobayashi et al. | |
| 2008/0093845 | A1 | 4/2008 | Higgins | |
| 2011/0185486 | A1* | 8/2011 | Brescia | E03D 11/135 4/252.2 |
| 2015/0128340 | A1* | 5/2015 | Davis, Jr. | E03F 5/0408 4/613 |
| 2015/0135424 | A1 | 5/2015 | Lin et al. | |
| 2016/0369483 | A1 | 12/2016 | Wade | |
| 2019/0330835 | A1 | 10/2019 | Betts | |

FOREIGN PATENT DOCUMENTS

| | | | | |
|---|---|---|---|---|
| AU | 2003236433 B2 | | 3/2008 | |
| JP | 2001123489 A | * | 5/2001 | E03C 1/1222 |

OTHER PUBLICATIONS

International Search Report for International application No. PCT/US22/23273 mailing date of Jul. 28, 2022.

* cited by examiner

*Primary Examiner* — Tuan N Nguyen
(74) *Attorney, Agent, or Firm* — KELLY & KELLEY, PLLC

(57) ABSTRACT

A method for interconnecting floor drains includes attaching a first elbow fitting to an existing floor drain through an existing floor. A second elbow fitting is attached to a new floor drain that is to extend through a new floor overlying the existing floor. An extension pipe extends between the spaced first and second elbow fittings to create a fluid pathway between the new floor drain and the existing floor drain.

22 Claims, 15 Drawing Sheets

METHOD FOR INTERCONNECTING FLOOR DRAINS

RELATED APPLICATION

This application claims the benefit of U.S. Provisional Application No. 63/175,250, filed on Apr. 15, 2021.

FIELD OF THE INVENTION

The present invention generally relates to plumbing. More particularly, the present invention relates to a method for interconnecting floor drains, which is particularly useful when a new drain during a remodel can be connected to an existing drain.

BACKGROUND OF THE INVENTION

In a typical shower arrangement for a bathroom on a ground level or on a concrete slab, a hole is formed through the concrete slab through which a shower drain is disposed. A waterproof membrane typically encases a lower portion of the shower to prevent water from leaving the shower and causing water damage to surrounding areas and materials. The floor is typically slightly sloped so that water will flow to the drain. The floor may be tiled. A similar arrangement is present when a bathtub is installed in the bathroom.

In a remodel situation, the bathtub or shower may be moved. When the redesign of the bathroom occurs, and the shower or bathtub is repositioned, such as three or five or even ten feet or more away from the old location, the plumber or builder has to jackhammer through the concrete slab for the new drain placement. Jackhammering through six-inch deep concrete to move the drain several feet is time-consuming and requires a lot of labor from a plumber or builder. Sometimes, there is hydronic heating in the concrete which further complicates the matter as the plumber or builder will not want to break a water line.

Outside of the remodel situation, at times a plumber may set a drain which is offset from the valves out of center. However, the drain and the valves must be aligned with one another so that they can be connected and properly drain the water from the bathtub or shower.

Accordingly, there is a need for a method for interconnecting an existing floor drain and a new floor drain. Such a method should include an adjustable drain attachment for attaching a drain offset from the valves out of center and/or when the shower or bathtub or the like is moved during a remodel in order to avoid having to create a hole through the concrete slab for the new drain placement. The present invention fulfills these needs, and provides other related advantages.

SUMMARY OF THE INVENTION

The present invention is directed to a method for interconnecting floor drains, such as attaching a drain offset from the valves out of center and/or when a new drain is to be installed in order to use the existing drain. The method of the present invention provides many benefits, such as avoiding the need to create a hole through the concrete slab for the new drain placement.

The method for interconnecting floor drains in accordance with the present invention generally comprises the steps of attaching a first elbow fitting to an existing floor drain through an existing floor. A second elbow fitting is attached to a new floor drain that is to extend through a new floor overlying the existing floor. The new floor drain is laterally spaced from the existing floor drain. An extension pipe is created having a length sufficient to extend between the first and second elbow fittings. A first end of the extension pipe is attached to the first elbow fitting. A second end of the extension pipe is attached to the second elbow fitting, such that a fluid pathway is formed between the new floor drain and the existing floor drain.

Typically, the first and second elbow fittings each have a first portion that is of a generally cylindrical configuration for attachment to the respective existing and new drains. The first and second elbow fittings each have a second portion which extends away from the first portion at an angle. This second portion of the first and second elbow fittings is of a reduced profile, such as having a generally flat configuration at once surface thereof and a generally curved configuration at a surface generally opposite the flat surface.

Preferably, the extension pipe also is of a reduced profile. The extension pipe may have a generally flat configuration at one surface thereof, and a generally curved configuration at a surface generally opposite the flat surface.

Creating the extension pipe may comprise cutting an elongated intermediate pipe to a desired length. Alternatively, or additionally, the extension pipe may be created by interconnecting multiple intermediate pipes and/or couplings to one another. The extension pipe may include a curved intermediate pipe to create a bend in the extension pipe.

The existing drain may be connected to spaced apart first and second new drains. The extension pipe may have a Y-shaped portion defining first and second branches which fluidly connect the first and second new drains to the existing drain.

The method of the present invention may include coupling at least one shim to a lower portion of the extension pipe to create a desired slope between the new and existing drains. The shim may comprise at least one U-shaped shim coupled to the extension pipe. One or more flat shims may be attached to the U-shaped shim to elevate at least a portion of the extension pipe to create the desired slope between the new and existing drains.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a system and method for interconnecting floor drains. The system and method of the present invention is particularly useful in showers which have been moved due to remodel. The present invention is also useful when a drain is offset from center from the valves. The system and method of the present invention may also be used in other instances when it is desirable to retain an existing floor drain and connect one or more new floor drains to the existing floor drain.

Figure 1:
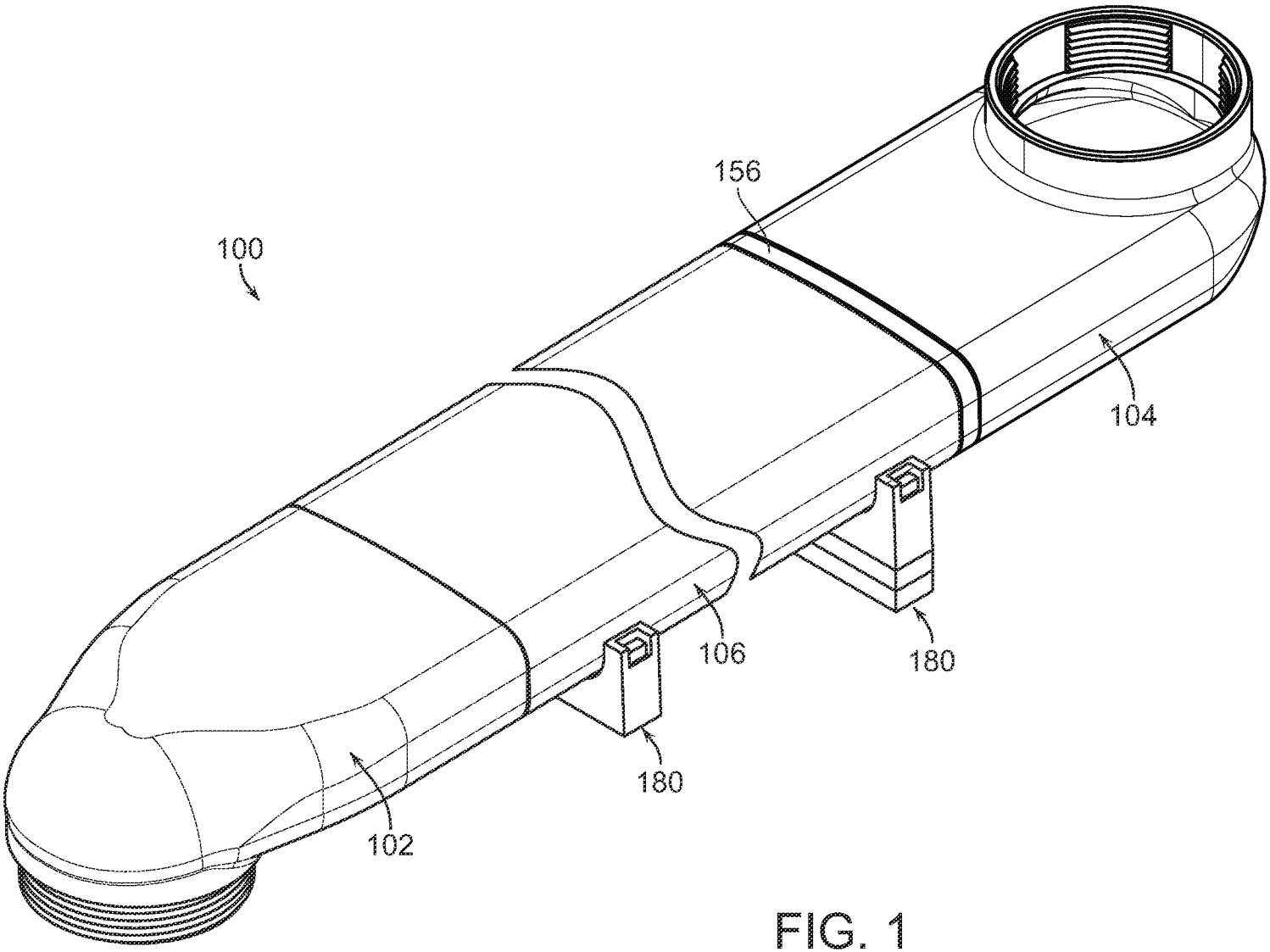
FIG. 1 is a top perspective view of a plumbing assembly, including an extension pipe extending between elbow fittings, used in accordance with the present invention.

With reference now to FIG. 1, a plumbing system 100 embodying the present invention is shown. The system 100 of the present invention generally comprises a first elbow fitting 102, which is to be operably connected to an existing floor drain. A second elbow fitting 104 is operably connectable to a new drain laterally spaced from the existing drain and which extends through a new floor 26 overlying the existing floor. An extension pipe 106, which may comprise a single pipe or a plurality of pipes, couplings, and other connectors, extends between the first and second elbows 102 and 104 to create a fluid pathway between the new floor drain and the existing floor drain, in accordance with the present invention.

Figure 2:
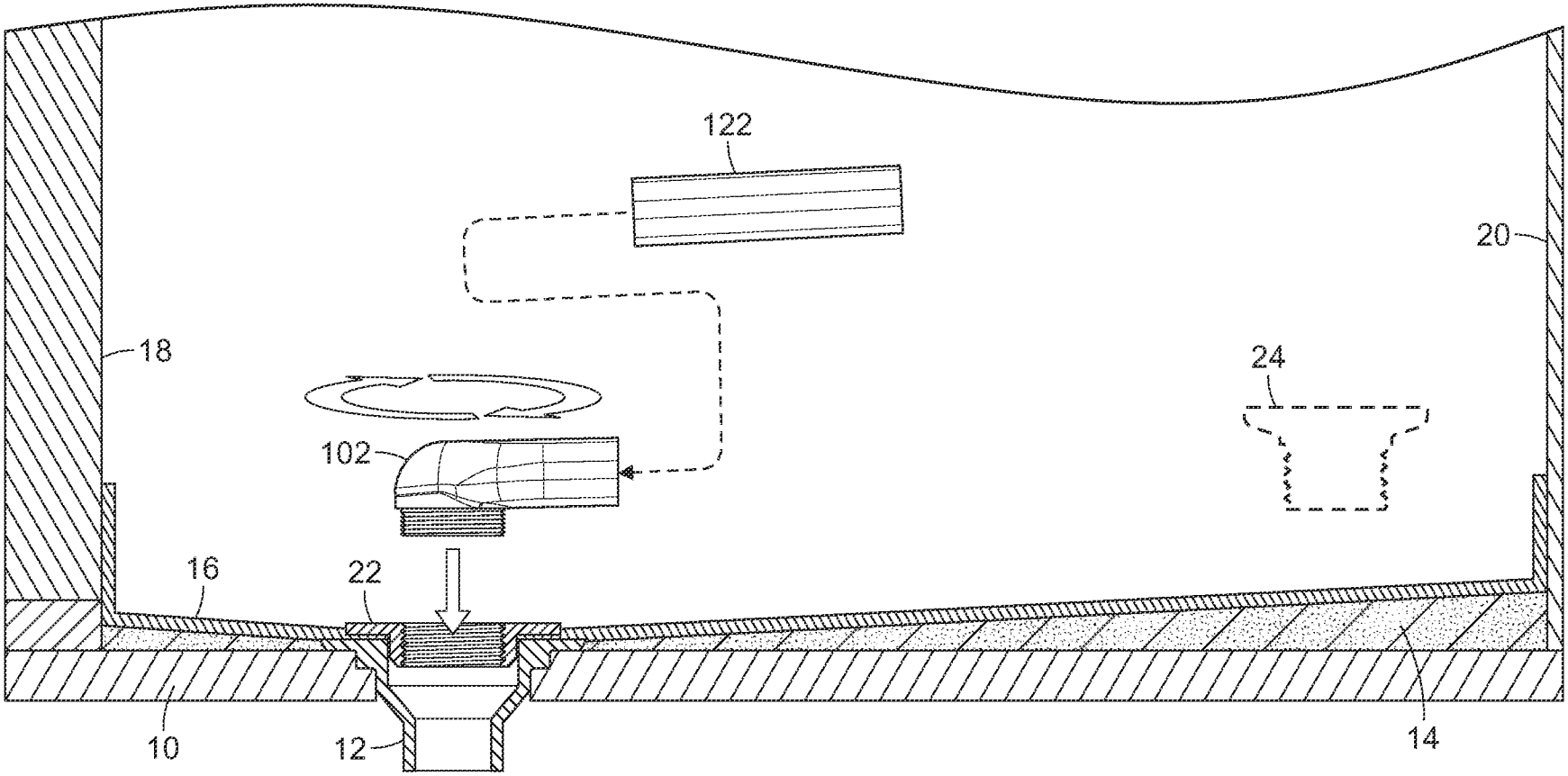
FIGS. 2-5 are cross-sectional and diagrammatic views illustrating the interconnection of an existing floor drain through an existing floor to a new floor drain extending through a new floor overlying the existing floor, in accordance with the present invention.

With reference now to FIG. 2, a shower arrangement for a bathroom is shown for exemplary purposes for the use and incorporation of the system 100 and method of the present invention, such as when a redesign of a bathroom occurs, such as during a remodel, and a shower or bathtub is repositioned. In the illustrated example, the shower is positioned on an existing floor 10, which may be ground level or more typically on a concrete slab 10. As is known in the art, a hole is formed through the concrete slab or existing floor 10 through which an existing drain 12 extends. A mortar bed 14 is typically formed above the floor or concrete slab 10, which is slightly sloped so that the water will flow to the drain 12. The existing floor may be considered to be the ground or concrete slab 10, the mortar bed 14 and/or tile, which may be placed on the mortar bed 14. Typically, a shower pan or waterproof membrane 16 encases a lower portion of the shower, such as extending along the floor and a distance of side walls, as illustrated, to prevent water from leaving the shower and causing water damage to surrounding areas and materials. Typically, the shower is at least partially enclosed by one or more walls 18 and 20, and may include a door or a curtain to close off the shower when in use and prevent water from spraying into the bathroom.

In accordance with the method of the present invention, the plumber or other installer confirms that the original plumbing is in place and proper. This includes confirming that the existing plumbing drain 12, including a bottom flange and P-trap with appropriate venting in accordance with local plumbing code requirements is present. As necessary, or desired, a new upper flange 22 may be installed to secure the waterproof membrane 16 between the flange 22 and drain 12 to ensure that the shower pan is waterproof and pre-pitched as required by plumbing codes, such as a 0.25 inch per foot pitch or fall.

With continuing reference to FIG. 2, the location of the new drain 24 is then determined. The new drain 24 is typically laterally offset from the existing drain 12. This distance may be a few inches or several feet or more. The distance between the existing drain 12 and the new drain 24 is then determined. As illustrated in FIG. 2, the new drain 24 is typically elevated with respect to the existing drain 12. This may be due to the fact that the new floor drain 24 is to extend through a new floor 26 overlying the existing floor. In any event, the new floor drain 24 must be elevated with respect to the existing floor drain 12 to create the proper pitch or slope between the new and existing drains 24 and 12 to ensure proper fluid flow therebetween.

With continuing reference to FIG. 2, a first elbow fitting 102 is attached to the existing floor drain 12. One end of the elbow fitting 102 is attached to the existing drain 12, either directly or to the flange 22 coupled thereto. This may be done by means of threaded connection or any other acceptable means.

Figure 6:
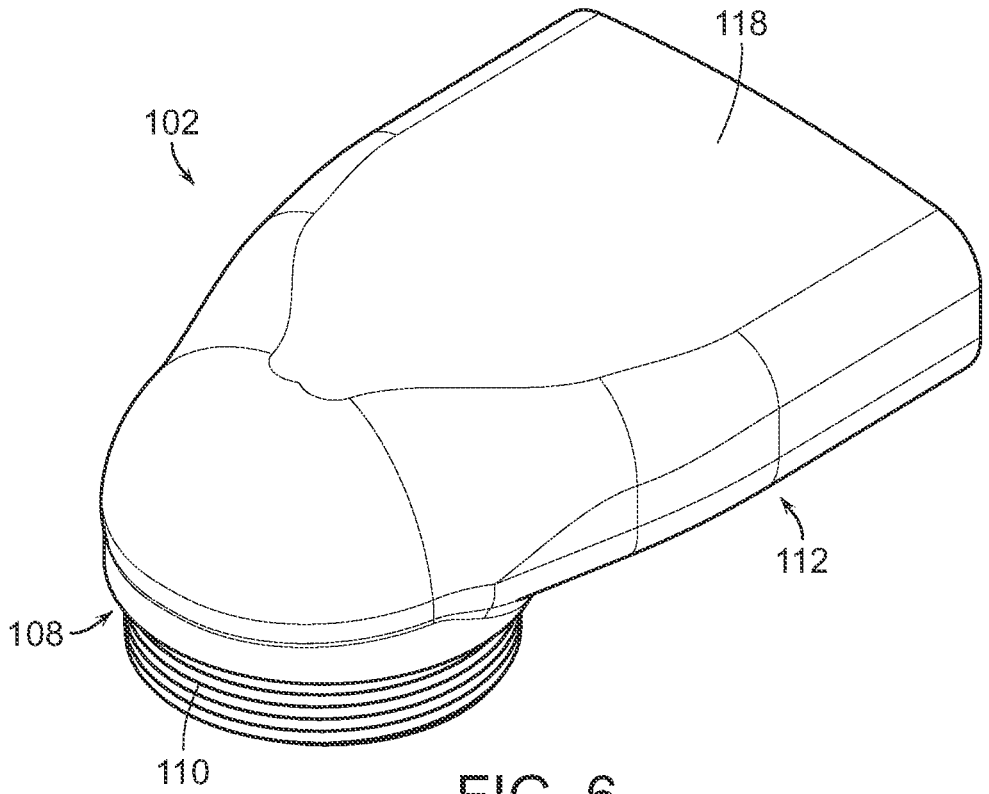
FIG. 6 is a top perspective view of an elbow fitting for attachment to an existing floor drain, in accordance with the present invention.
Figure 7:
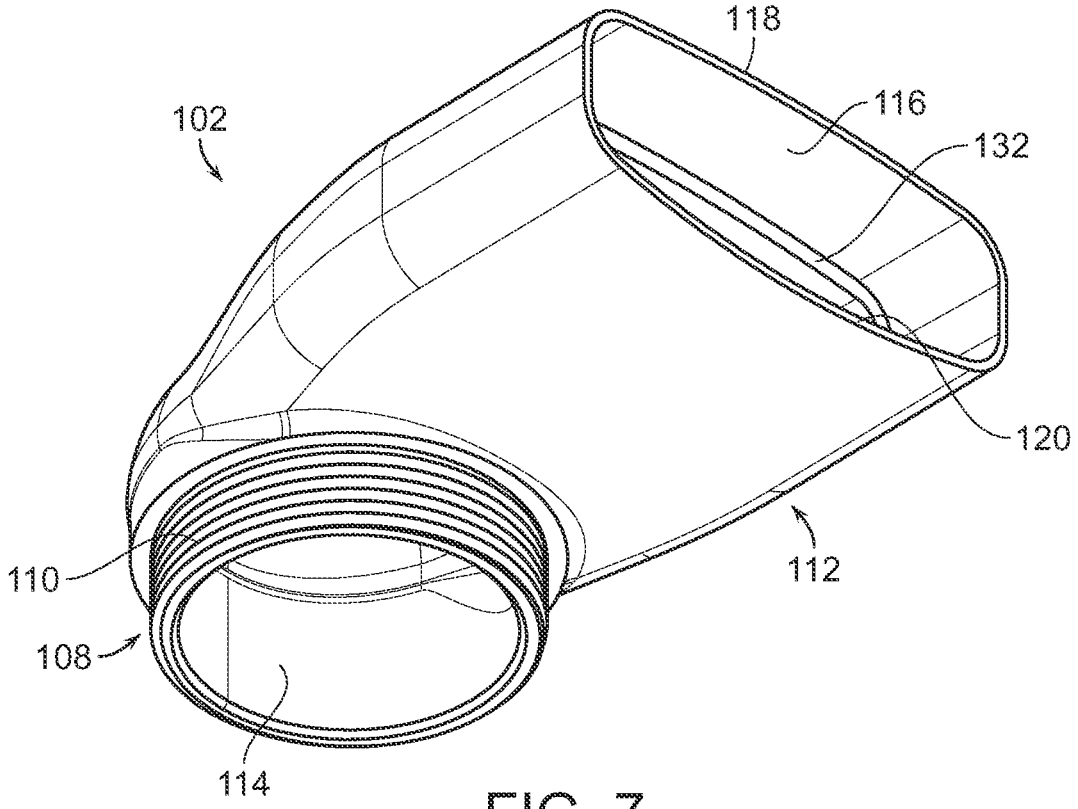
FIG. 7 is a bottom perspective view of the elbow fitting of FIG. 6.

With reference now to FIGS. 6 and 7, a first elbow fitting 102 embodying the present invention is shown. A first portion 108 is generally directed downwardly. The first portion 108 is typically circular and having an outer diameter which is slightly less than an inner diameter of the connecting portion of the existing drain 12. The first portion 108 may include external threads 110 for threaded attachment to the existing drain 12. In this manner, the first elbow fitting may be rotatedly and threadedly attached to the existing drain 12, such as to the coupled flange 22 and tightened in place, as shown by the directional arrows in FIG. 2.

With continuing reference to FIGS. 6 and 7, the first elbow fitting 102 also has a second portion 112, which extends away from the first portion 108 at an angle, such that an outlet 114 and an inlet 116 of the elbow fitting 102 are offset from one another, such as generally at a ninety degree angle with respect to one another. Given the small space between the bottom of the shower, such as at the top of the new floor, and the existing floor or concrete slab 10, preferably the first and second portions 108 and 112 of the first elbow fitting 102 are disposed at an approximately ninety degree angle to one another. Moreover, preferably while the first portion 108 is generally cylindrical, so as to be operably inserted and attached to the existing drain 12, the second portion 112 is of a reduced profile so that it can fit under the shower and above the slab or existing floor 10 without having to disturb the waterproofing 16 or existing drain 12 that is already in place.

In order to achieve the benefits of having a low profile, at least one surface 118 of the second portion 112 of the first elbow fitting 102 is flattened so as to have a generally flat configuration. While the second portion 112 may have a generally rectangular cross-sectional area, more preferably, a generally opposite surface 120 of the second portion 112 has a generally curved configuration, as illustrated in FIG. 7. Thus, the second portion 112, at least towards the inlet end 116 has a generally D-shaped cross-sectional area. Preferably, the cross-sectional area of the inlet 116 is approximately equal to the cross-sectional area of the outlet 114 so as to enable the shower water to drain easily through the first elbow fitting 102 and to the existing drain 12. Regardless, the cross-sectional area of the second portion 112 should be sufficiently large so as to enable the shower water to drain therethrough easily. Thus, the cross-sectional area of the inlet 116 may be substantially equivalent to or slightly less than or slightly larger than the cross-sectional area of opening outlet 114 so as not to impede the flow of fluid between the drains 24 and 12.

For purposes of illustration, the first elbow fitting 102 may have the following dimensions, although it will be understood that the invention is not limited to such. The first portion 108 may have a diameter of approximately two inches. The first portion may rise vertically approximately two inches. The second portion 112 may extend approximately five inches from one end of the elbow fitting to the generally opposite end. The inlet 116 may have a width of approximately three inches, and a height of approximately 1.25 inches. Thus, it can be seen that the reduced profile of the second portion 112 is of a wider width than the width of the outlet 114 of the first portion 108, but of a flattened or lower profile height, to achieve the purposes of the present invention of providing the benefits of a low profile for placement purposes while providing a sufficiently large cross-sectional area in relation to the outlet 114 and the existing drain 12 so as to not impede fluid flow therethrough.

Figure 3:
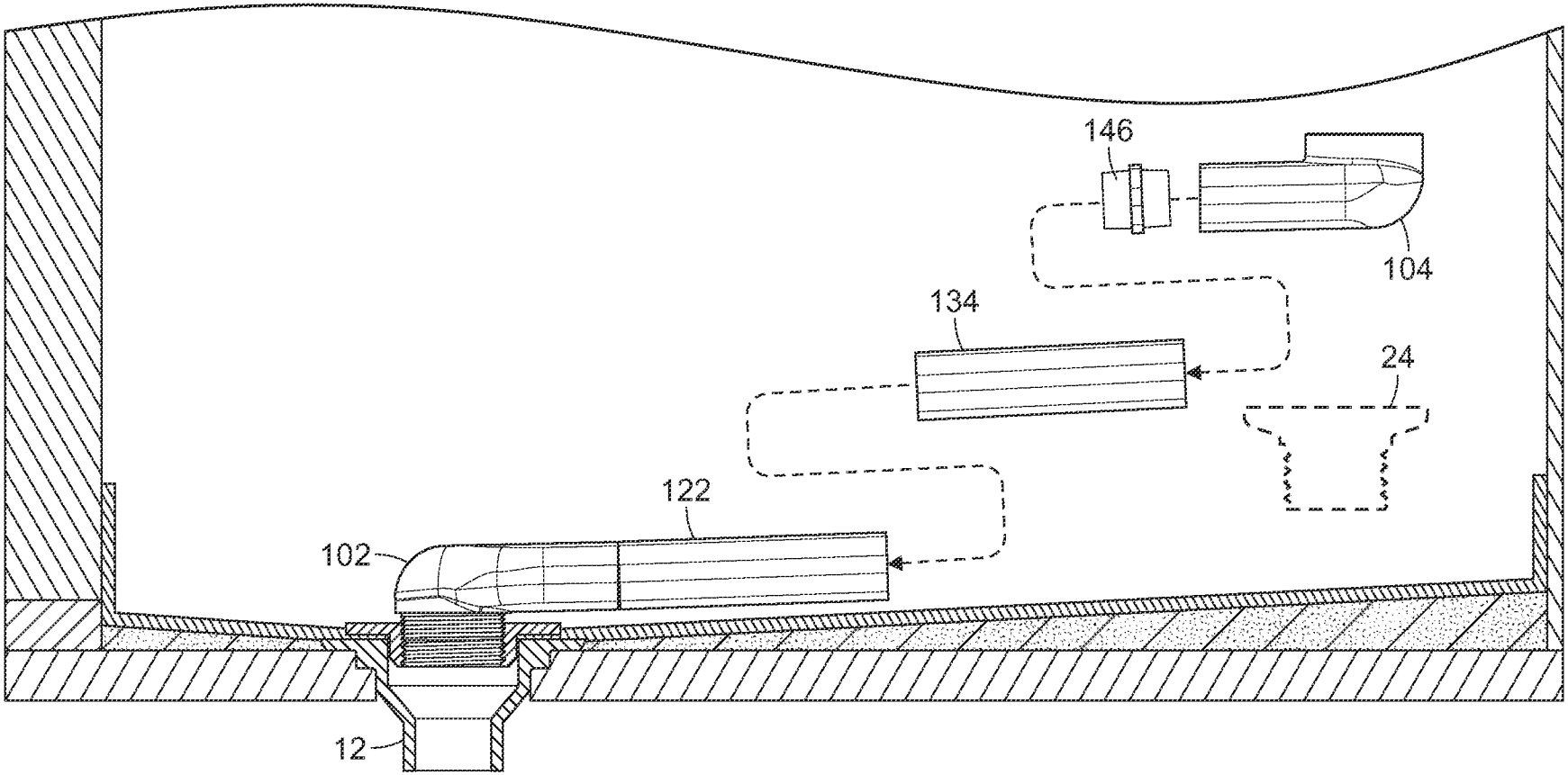

With reference now to FIGS. 2 and 3, as the first elbow fitting 102 is attached to the existing drain 12, it is positioned, such as being rotated, as shown by the directional arrows in FIG. 2, such that the inlet 116 thereof is pointed towards the direction of the new drain 24 placement. This sets one end of the system 100 and helps the installer determine the total assembly length of other fittings for proper installation. The extension pipe 106 can then be created which will extend between the first elbow fitting 102 attached to the existing drain 12 and the second elbow fitting 104 attached to the new drain 24. Depending upon the circumstances, the extension pipe 106 may be comprised of a single intermediate pipe or multiple pipes and/or couplings interconnected with one another between the first and second elbow fittings 102 and 104.

Figure 8:
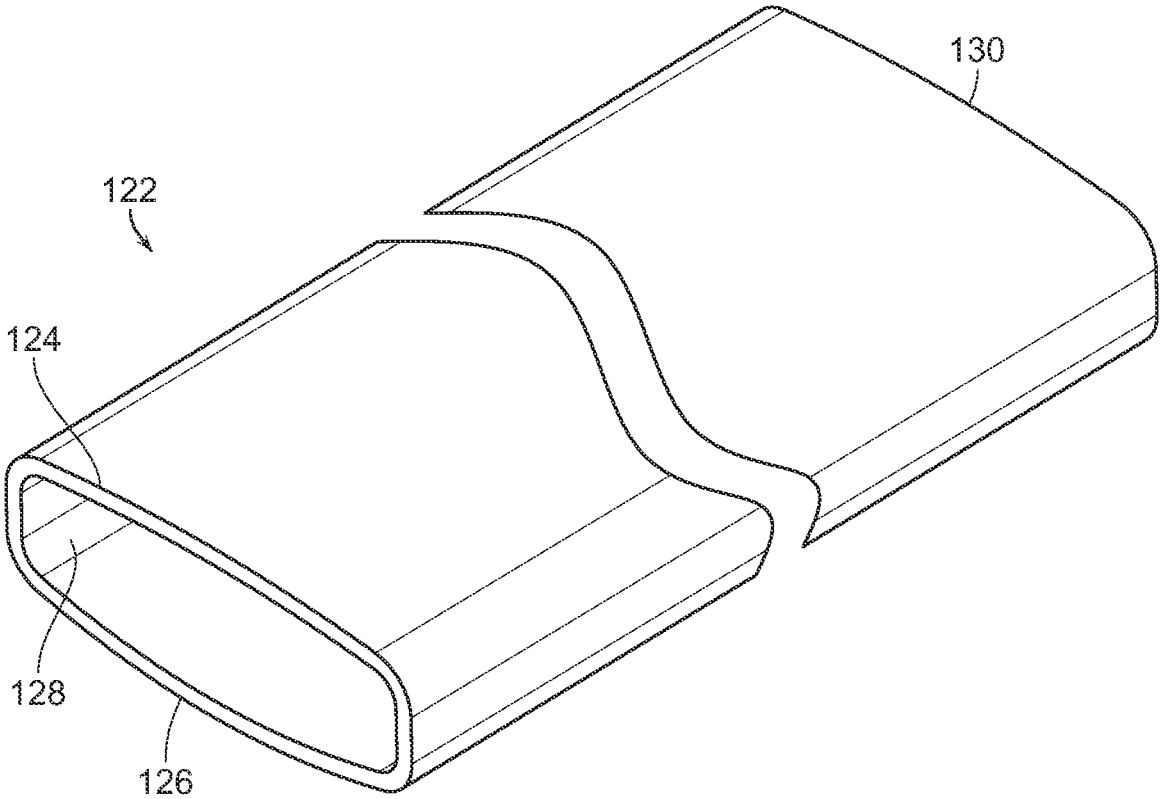
FIG. 8 is a perspective view of an extension pipe, used in accordance with the present invention.

With reference now to FIG. 8, an elongated intermediate pipe 122 may be used either as the extension pipe or forming a portion thereof. The intermediate pipe 122 may be provided in different lengths, such as being multiple feet in length. The intermediate pipe 122 may be cut to the desired length, so as to either extend between the first and second elbow fittings 102 and 104 or to form a portion of the extension pipe. Thus, the intermediate pipe 122 could be considered to be an adjustable middle piece. It may be offered, for example, in dimensions of eighteen inches or more in length. It may have a wall thickness of one eighth of an inch.

Preferably, the intermediate pipe 122 also has a reduced profile, such as having a generally rectangular cross-sectional area or more preferably, as illustrated, having a flat upper surface 124 and a curved lower surface 126 generally opposite the upper surface 124. This would provide a generally D-shaped cross-sectional area which would provide a low profile while also providing a sufficiently large cross-sectional area through the hollow pipe 122, between the inlet 128 and outlet 130 thereof to accommodate the water passing through the drains 24 and 12 without impeding the fluid flow. For example, the intermediate pipe 122 could have an elongated width of 2.75 inches, and a maximum height of one inch.

The intermediate pipe 122 may be sized and configured so as to be inserted directly into the inlet 116 of the first elbow fitting 102. The open end 116 of the second portion 112 of the first elbow fitting 102 may have a shoulder 132 disposed therein a distance from the open end to act as a stop when inserting the intermediate pipe 122. The shoulder 132 may be formed by having the peripheral walls extending between the shoulder 132 and the open end of the second portion 112 being of a reduced cross-sectional diameter compared to the remaining wall thicknesses of the second portion 112. Alternatively, the shoulder 132 may be formed as a rib within the second portion 112 in the desired spaced distance from the opening 116 during the manufacturing process. The outer diameter configuration of the intermediate pipe 122 is slightly less in size than the inlet opening 116 so as to be snuggly fit therein. Adhesive, such as solvent cement, could be used to sealingly connect an end of the intermediate pipe 122 to the first elbow fitting 102, or even the second elbow fitting 104 or any other coupled pipes or couplings or the like.

Figure 9:
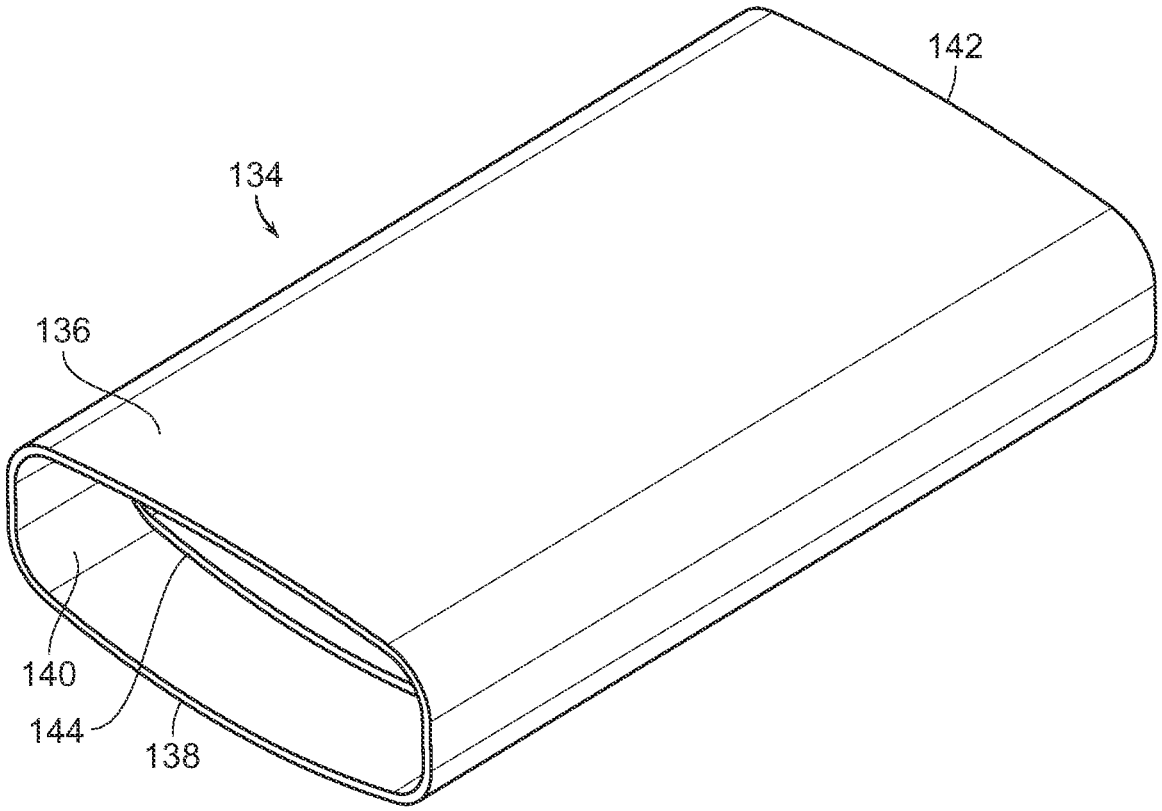
FIG. 9 is a perspective view of a coupling pipe, used in accordance with the present invention.

With reference now to FIG. 9, the extension pipe 106 may comprise one or more intermediate coupling pipes 134. The coupling pipe 134, similar to the intermediate pipe 122, is also preferably of a reduced profile, such as having a generally rectangular cross-sectional area or more preferably having a generally flat top surface 136 and a generally curved bottom surface 138, forming a D-shaped cross-sectional area, as illustrated. The coupling pipe 134 is also hollow between the inlet 140 and outlet 142 ends thereof.

Unlike the elongated intermediate pipe 122, the coupling pipe 134 is typically not capable of being cut to a desired length. This is due to the coupling pipe 134 having ends which are configured and adapted for coupling to another component of the extension pipe, such as an end of the intermediate pipe 122. Similar to the end of the second portion 112 of the first elbow fitting 102, each end of the coupling pipe 134 includes a shoulder 144 formed on an inner surface of the coupling pipe 134 a distance from the open edge defining the inlet 140 or outlet 142. This distance is typically sufficiently large so as to interconnect an end of the intermediate pipe 122 or other component thereto, such as being approximately one inch from the open end of the coupling pipe 134. The shoulder 144 may be formed by a rib extending from the interior surface of the coupling pipe 134 created during the manufacturing process, or by creating each open end having a reduced wall thickness to create the shoulder 134, which will create a stop when inserting the end of the intermediate pipe 122 or other coupling or pipe component.

Exemplary dimensions for a coupling pipe 134 used in connection with the present invention may be three inches in diameter and 1.25 inches in height. The length of the coupling pipe 134 could vary, and be offered in various lengths, but is typically less than a foot in length, such as being approximately five or six inches in length. The wall thickness of the coupling pipe 134 may be 3/16 of an inch thick, and in the case where the area adjacent to each open end 140 and 142 are of a reduced wall thickness so as to create shoulder 144, the sleeve wall in such a case may be only 1/16 of an inch in thickness to create a generally circumferential shoulder or rib 144 of 2/16 of an inch in height.

Figure 10:
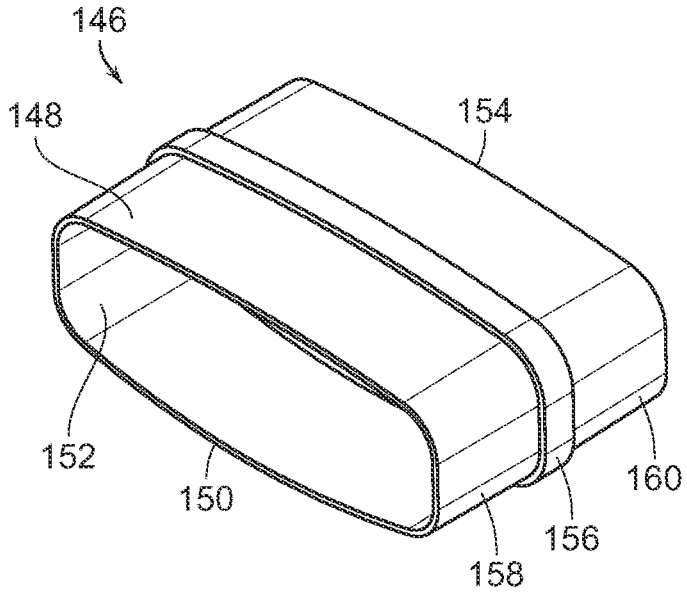
FIG. 10 is a perspective view of an inner sleeve coupling, used in accordance with the present invention.

With reference now to FIG. 10, the extension pipe may also include one or more sleeve couplings 146. The sleeve couplings 146 may be used, for example, to interconnect the coupling pipes 134 to one another or an end of a coupling pipe 134 to the first or second elbow fitting 102 or 104. The sleeve coupling 146 is also preferably of a reduced profile, such as having a generally rectangular cross-sectional area or more preferably having a top surface 148 of a flattened configuration and a generally opposite bottom surface 150 being curved, such as to form a generally D-shaped cross-sectional area. The sleeve coupling 146 is generally hollow and has generally opposite open ends 152 and 154.

A rib 156 extends upwardly from an outer surface of the sleeve coupling 146, intermediate ends 152 and 154. The rib 156 may be disposed generally equidistant between the open ends 152 and 154. This creates sleeves 158 and 160 of comparative reduced diameter with respect to the rib 156 which are sized and configured so as to be inserted into an open end of the coupling pipe 134 and/or second portion of the first or second elbow fitting 102 or 104. This can be seen, for example, in FIG. 3.

Sleeves 158 and 160 have an outer dimension which is insertable into the ends of the elbow fittings 102 or 104 and/or coupling pipe 134, until engaging a shoulder thereof. Preferably, the width of the sleeve 158 or 160 is approximately the same length as the distance between the open end and the shoulder 144 of the coupling pipe 134 or the shoulder 132 and the open end of the elbow fitting 102 or 104. Preferably, the rib 156 provides a smooth transition between an outer surface of the coupling pipe 134 or end of the second portion of the elbow fitting 102 or 104, as illustrated in FIG. 1. The sleeve coupling 146 may be attached with adhesive, such as solvent cement, to form a permanent and waterproof bond between it and the elbow fitting 102 or 104 and/or coupling pipe 134.

The sleeve coupling may have the following dimensions, for exemplary purposes. The sleeve wall may be approximately 1/8 of an inch in thickness. The sleeve coupling 146 may be approximately two inches in length, and 2 7/8 inches in width and approximately one inch in height. The rib may extend outwardly approximately 1/4 inch. These dimensions are exemplary and the invention is not limited to such.

Figure 13:
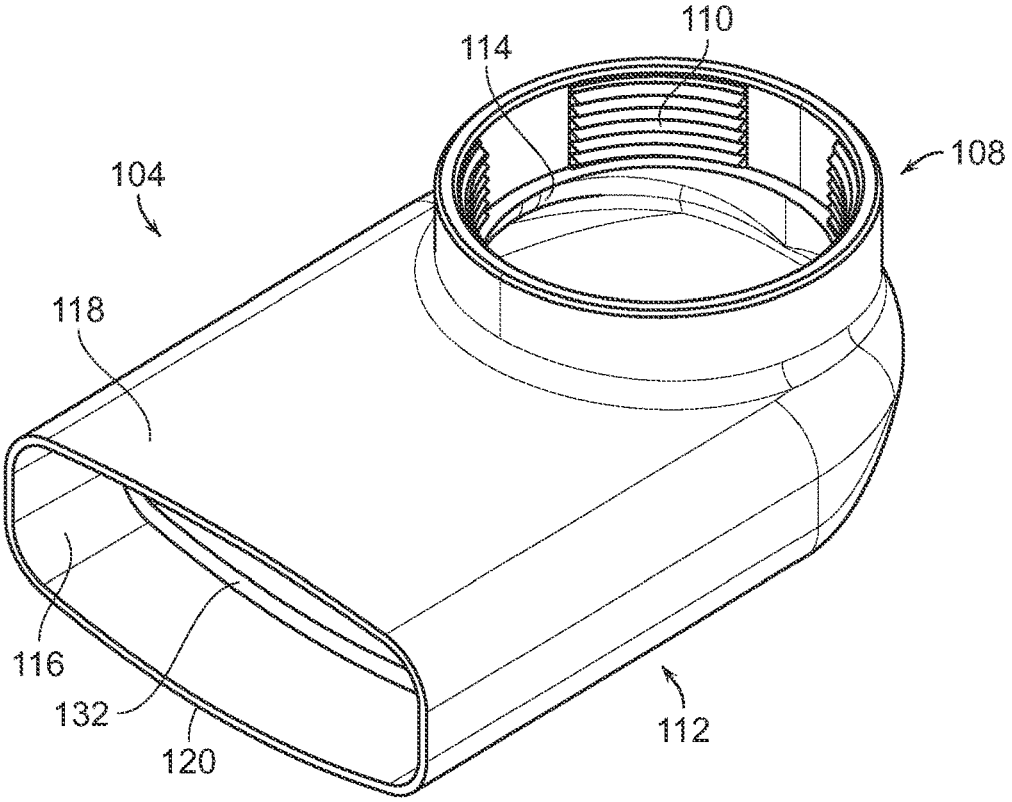
FIG. 13 is a top perspective view of an elbow fitting attachable to a new drain, in accordance with the present invention.
Figure 14:
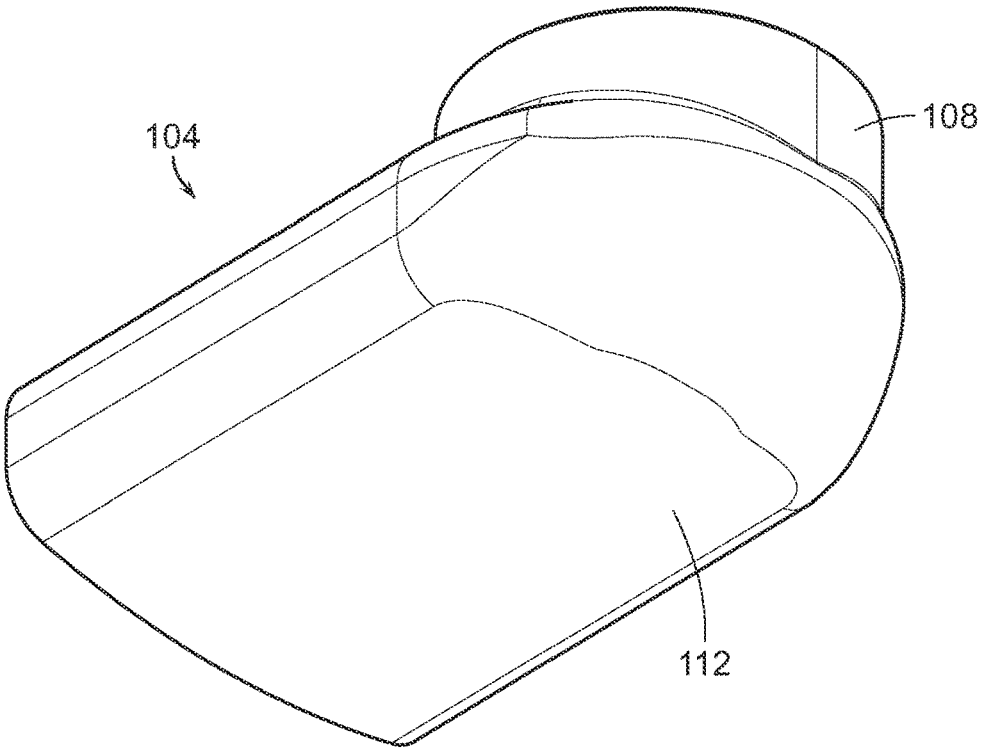
FIG. 14 is a bottom perspective view of the elbow fitting of FIG. 13.

With reference now to FIGS. 13 and 14, the second elbow fitting 104 is shown. It has a similar configuration as the first elbow fitting 102 in that it has a first portion 108 which is configured to be attached to the new floor drain 24, and as such is typically cylindrical. Opening 114 forms a fluid inlet from the new drain 24 in this case, and the first portion 108 may include internal threads 110 for coupling to external threads of the new floor drain 24. Alternatively, the first portion 108 of the elbow fitting 104 may be configured to be attached to the new floor drain 24 by other means, such as adhesive connection or the like. Once again, the first portion 108 and the second portion 112 are offset from one another such that openings 114 and 116 are formed at a generally ninety degree angle with respect to one another. Also, the second portion 112 is of a reduced profile, which may be of a generally rectangular cross-section, but more preferably, as illustrated, has one surface 118 of a generally flattened configuration and a generally opposite surface having a generally curved configuration, so as to form a generally D-shaped cross-sectional configuration. Similar to the first elbow fitting 102, the second elbow fitting 104 includes a shoulder 132 extending inwardly a distance from opening 116, such as approximately one inch.

The second elbow fitting 104 may have the following exemplary dimensions. Opening 116 may be approximately three inches in width and approximately 1.25 inches in height, similar to the opening 116 of the first elbow fitting 102. The internal diameter of opening 114 may be 2 and 5/8 of an inch in diameter so as to receive the coupling portion of the new floor drain 24 therein. The second elbow fitting 104 may also be slightly smaller than the first elbow fitting 102, in that the first portion is only 1.75 inches in vertical height, and the second portion 112 may not be as long as the second portion 112 of the first elbow fitting 102. The second elbow fitting 104 may have a wall thickness of 3/16 inch, a thread wall of 1/4 inch, and a sleeve wall, forming shoulder 132 of 1/16 inch in thickness. It will be appreciated, however, that these dimensions are merely exemplary and the invention is not so limited.

Figure 15:
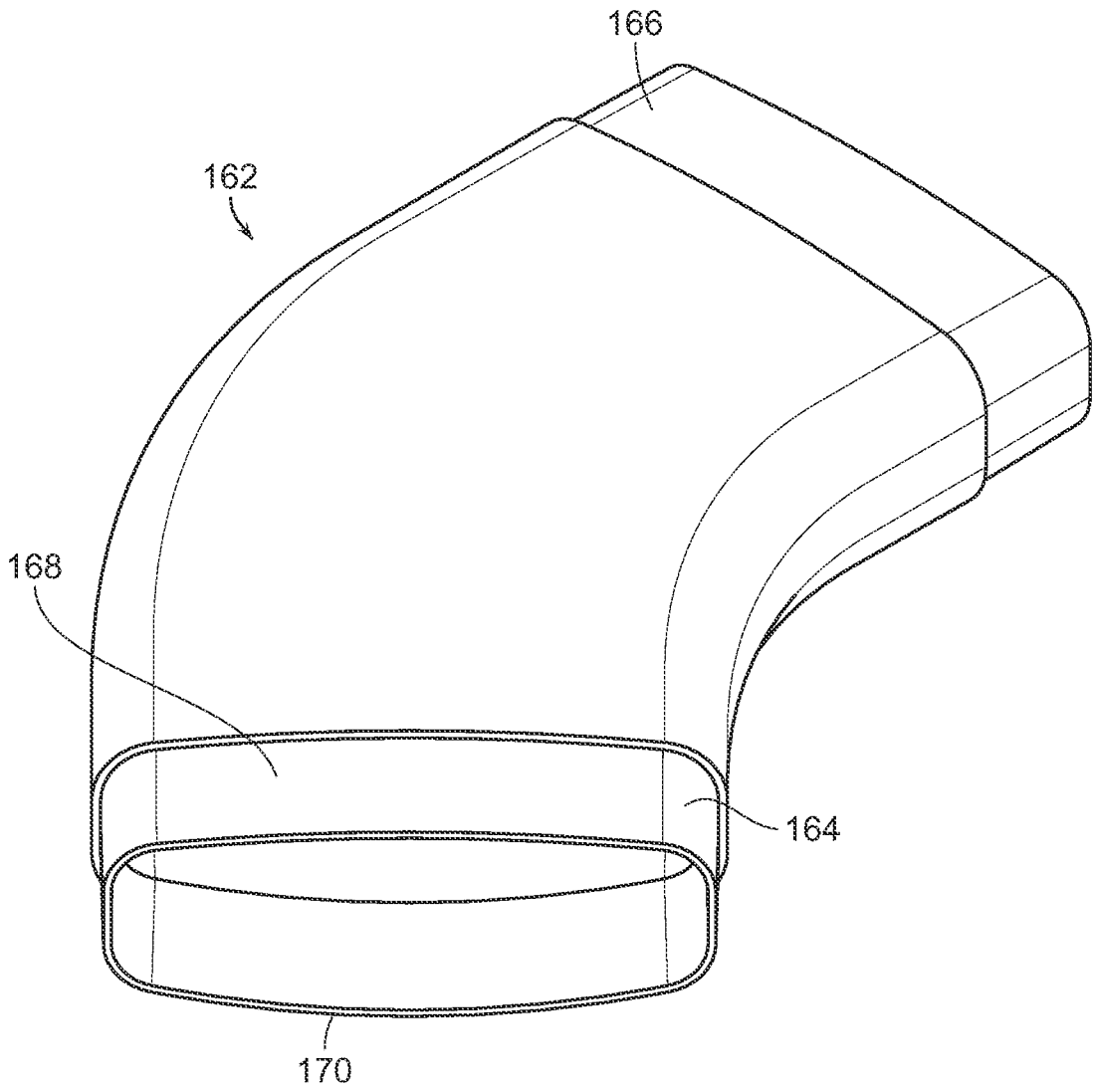
FIG. 15 is a perspective view of a curved intermediate pipe, used in accordance with the present invention.

With reference now to FIG. 15, the extension pipe 106 may include a curved intermediate pipe 162, such as for creating one or more bends in the extension pipe. The curved intermediate pipe 162 may have a desired curved radius, such as a fifteen degree angle allowing the extension pipe 106 to turn a fifteen degree corner. It will be understood that the angle or amount of curved radius can be altered, such that the curved intermediate pipe 162 is offered in varying angles. The curved intermediate pipe 162 may be offered in various lengths. As illustrated, the ends 164 and 166 may be of a reduced wall thickness so as to create first and second sleeves 164 and 166 which may be inserted, for example, into the ends of coupling pipe 134, or other component, for attachment thereto.

Exemplary dimensions of the curved intermediate pipe 162 may be approximately five inches in length, and 3.375 inches in width at the central portion thereof, with the end sleeve portions 164 and 166 being 3.25 inches in width. In the central portion, the pipe wall may be 0.1375 inches in thickness, and 0.125 inches at the sleeve ends 164 and 166. Similar to the other components illustrated and described above, preferably, the curved intermediate pipe 162 is of a reduced profile, such as having a generally rectangular cross-sectional area, or more preferably having a flat upper surface 168 and a curved lower surface, so as to have a generally D-shaped cross-sectional configuration.

Figure 16:
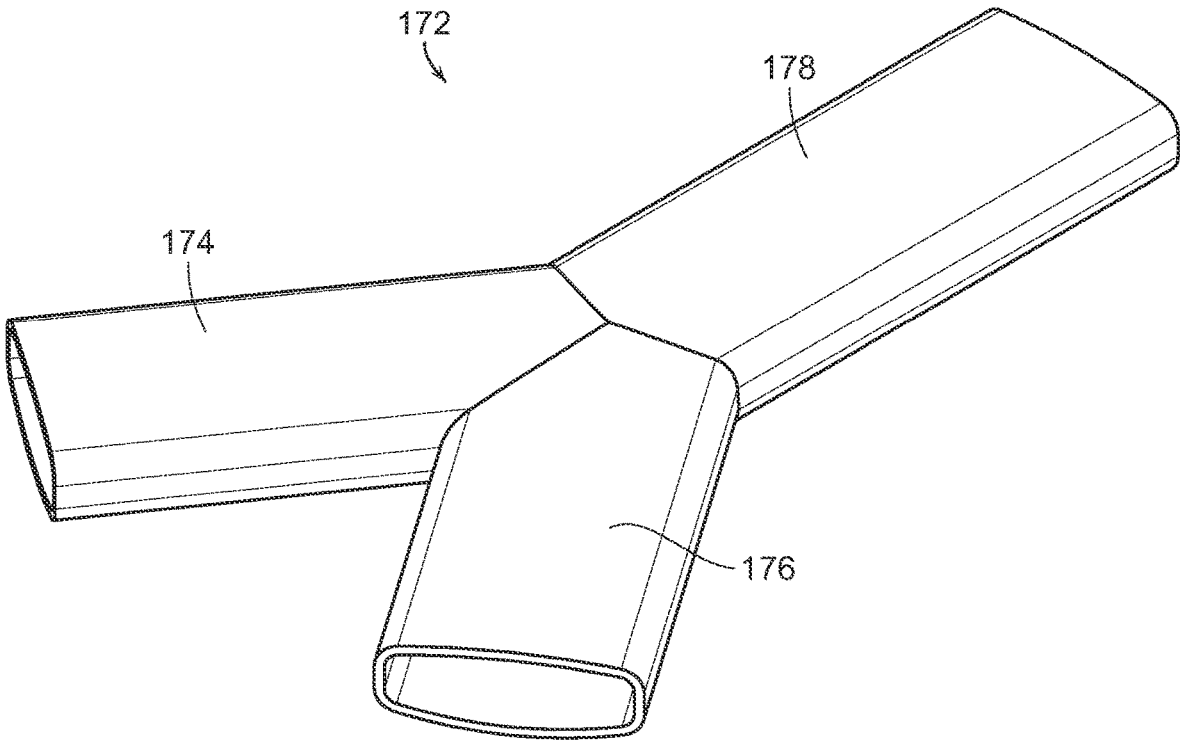
FIG. 16 is a perspective view of a Y-shaped extension pipe, used in accordance with the present invention.

With reference now to FIG. 16, the present invention contemplates multiple new drains 24 being simultaneously connected to the existing drain 12, such as having two new drains 24 connected to the existing drain 12. In such a case, a Y-shaped intermediate pipe section 172 is provided having first and second branches 174 and 176 which extend from a main portion 178. The branches 174 and 176 will extend towards the new drains 24, while the main portion 178 will extend to the existing floor drain 12. In the case where there were two existing drains and only one new drain, the opposite arrangement could be used with the main portion 178 extending to the new drain. The Y-shaped intermediate attachment pipe will preferably have inner shoulders formed therein, similar to the coupling pipe 134 for attachment to the elongated intermediate pipe 122 and/or sleeve coupling 146 or even an end of the curved intermediate pipe 162, as described above.

Figure 4:
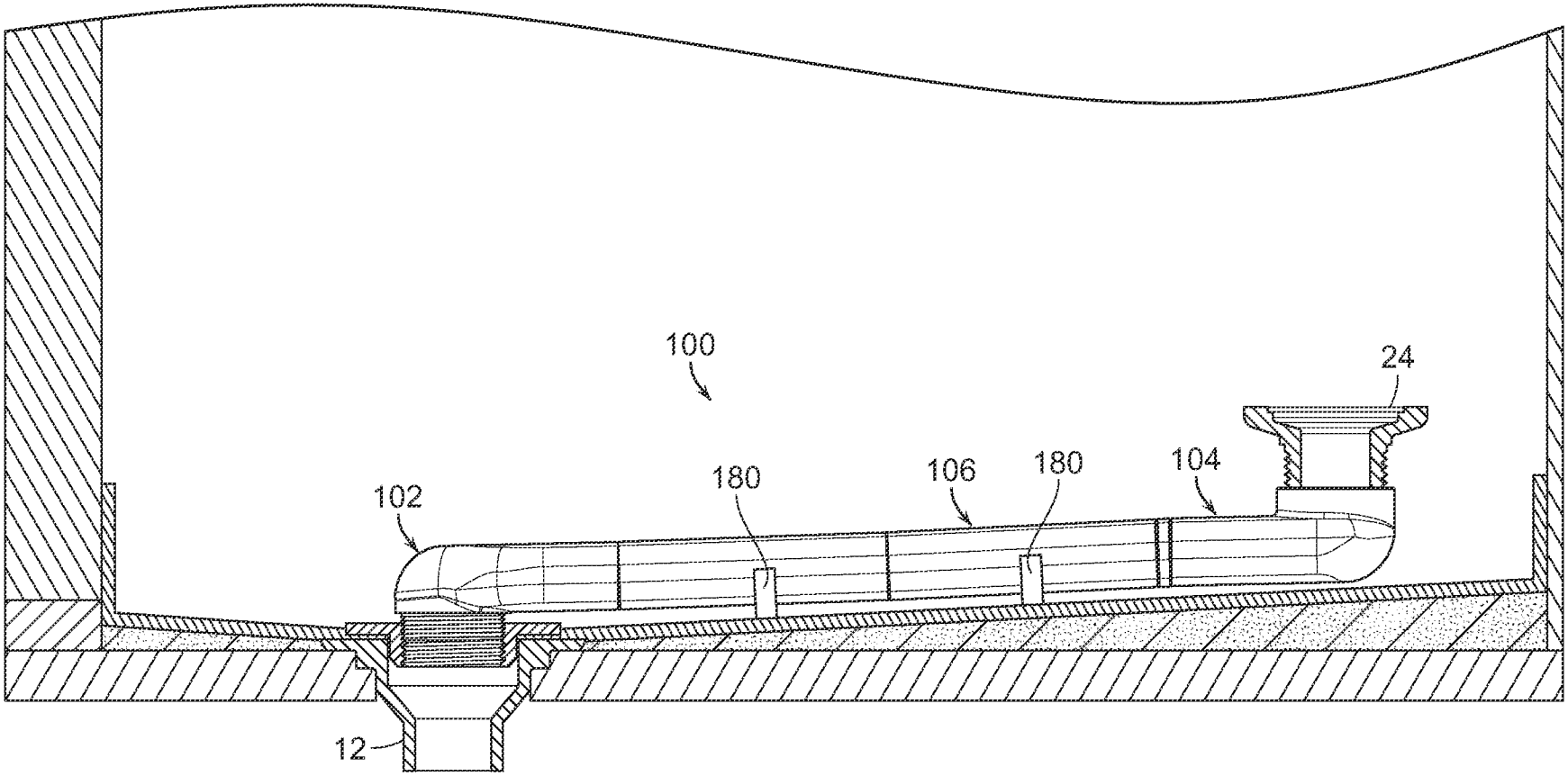

With reference to FIGS. 3 and 4, the extension pipe 106 is created to interconnect the existing floor drain 12 and the new floor drain 24. As mentioned above, this may be by means of cutting an elongated intermediate pipe 122 to the proper length between the first and second elbow fittings 102 and 104, and/or coupling multiple components to one another, which may include any combination of an elongated intermediate pipe 122, a coupling pipe 134, one or more sleeve couplings 146, one or more curved intermediate pipes 162, etc.

An installer may wish to test fit the various interconnected components forming the extension pipe 106 to ensure that it properly reaches between the first and second elbow fittings 102 and 104, which are coupled to the existing drain 12 and new drain 24, respectively. These components may then be cemented to one another, such as using an adhesive, such as solvent cement, to form a watertight bond.

With reference to FIG. 4, to ensure that the water flows down from the new drain 24 to the existing floor drain 12, a minimum desired slope between the new and existing drains 24 and 12 is needed. For example, a proper fall is usually ¼ inch per linear foot between the new drain 24 and existing floor drain 12. In such a case, if the new shower drain 24 is placed two feet from the existing floor drain 12, to ensure proper flow, the new drain 24, as well as the extension pipe 106 would have to be elevated at a height of ½ inch. This may be accomplished by using at least one shim 180 coupled to the extension pipe 106 to create a desired slope between the new drain 24 and the existing drain 12, as illustrated in FIG. 4.

Figure 11:
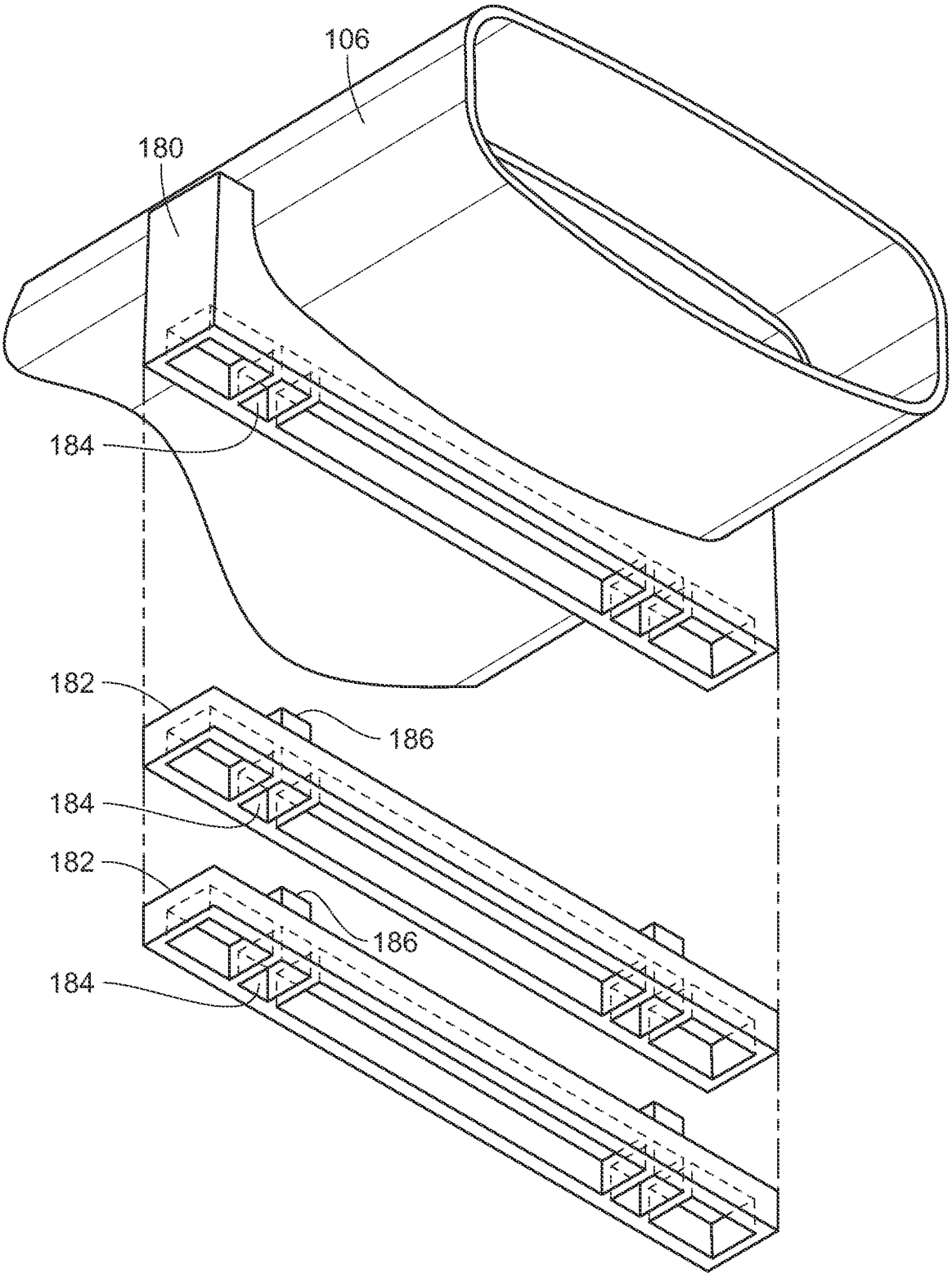
FIG. 11 is a bottom perspective and exploded view illustrating attachments of shims to an extension pipe, in accordance with the present invention.
Figure 12:
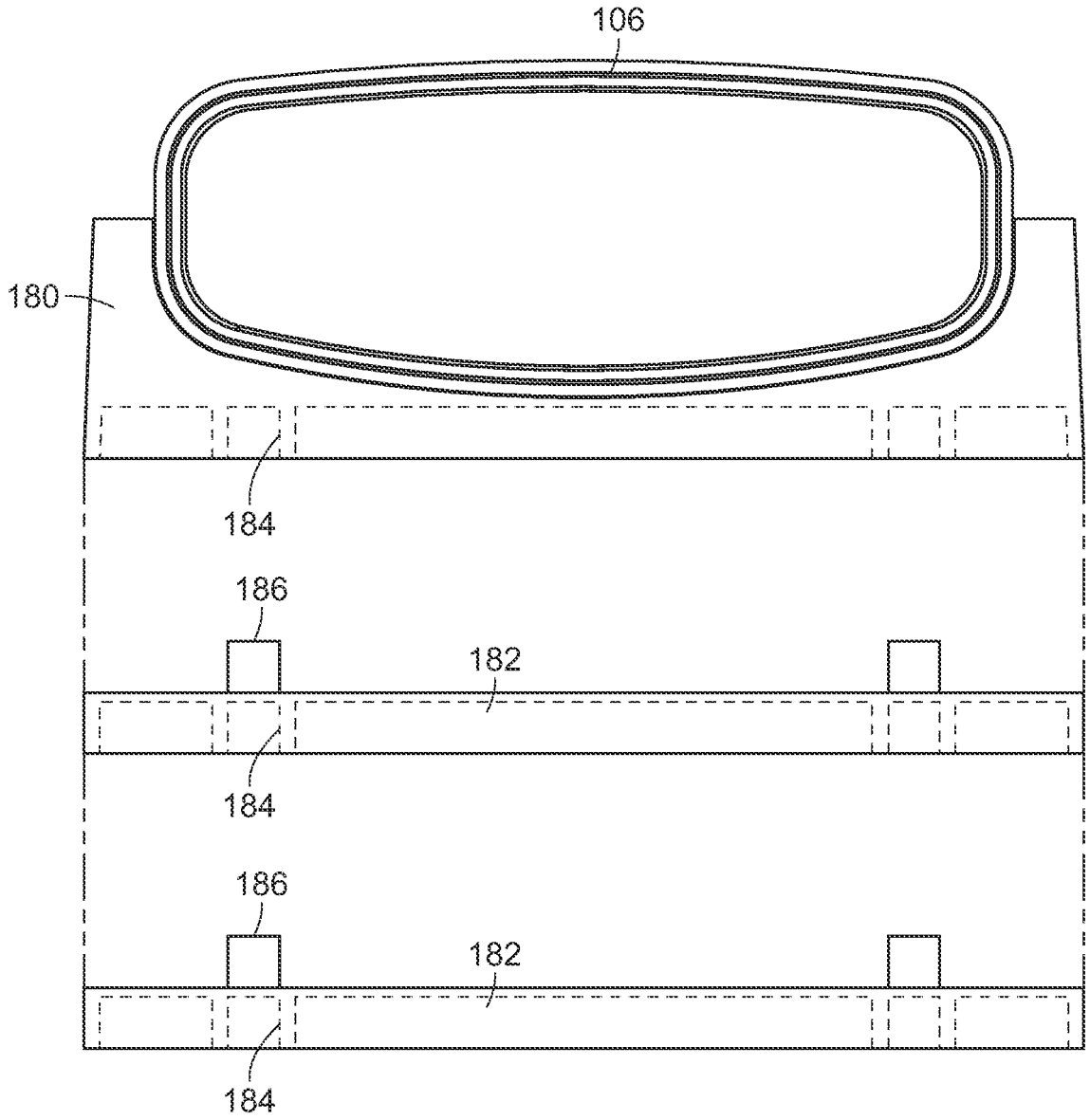
FIG. 12 is a front end view of the arrangement of FIG. 11, illustrating coupling of shims to an extension pipe, in accordance with the present invention.

With reference now to FIGS. 11 and 12, a segment of the extension pipe 106 is shown having a shim 180 attached thereto so as to raise that portion of the extension pipe 106 to achieve the desired slope, such as ¼ inch fall per foot. At least one shim 180 is attached to a lower portion of the extension pipe 106 to create the desired slope between the drains 24 and 12. In a particularly preferred embodiment, as illustrated, a U-shaped shim 180 is configured so as to receive a lower portion of the extension pipe 106 therein, such as by being snap-fit into place. The shim 180 may also be attached by other means, such as by means of adhesive or the like. The shim 180 is configured so as to raise the extension pipe 106 one-quarter of an inch. One or more flat shims 182 may be used to increase the overall height of the shim, and thus the extension pipe 106 and new drain 24. Preferably, these flat shims 182 are of a predetermined height, such as one-quarter inch, so that the elevation of the extension pipe 106 and new drain 24 may be controlled in one-quarter-inch increments, although the invention is not necessarily limited to such as the shims 180 and 182 may have varying thicknesses or heights.

As illustrated in FIGS. 11 and 12, with the primary U-shaped shim 180 having the lower portion of the extension pipe 106 disposed in its U-shaped cavity, generally conforming to the lower surface of the extension pipe 106, one or more additional flat shims 182 may be attached to the U-shaped primary shim. This may be done, for example, by providing recesses 184 in the lower portion of each shim 180 or 182, into which is received a projection 186 from a lower shim to be attached to the shim above it. In this manner, a number of shims can be easily and quickly interconnected, or even detached, from one another to achieve the desired height at that portion of the extension pipe 106.

FIGS. 11 and 12 illustrate one primary U-shaped shim 180 attached to the extension pipe 106, with two flat shims 182 attached thereto. This would provide, in the case where the shims 180 and 182 are each one-quarter inch in height a total height or elevation of three-quarter inch. This could be increased or decreased, based upon the number of shims used. Utilizing three shims might be desirable, for example, near the new drain 24. However, a single shim 180 may be used closer to the existing drain 12, as illustrated in FIG. 1, so as to achieve the desired slope or fall per foot to ensure proper water drainage.

Figure 5:
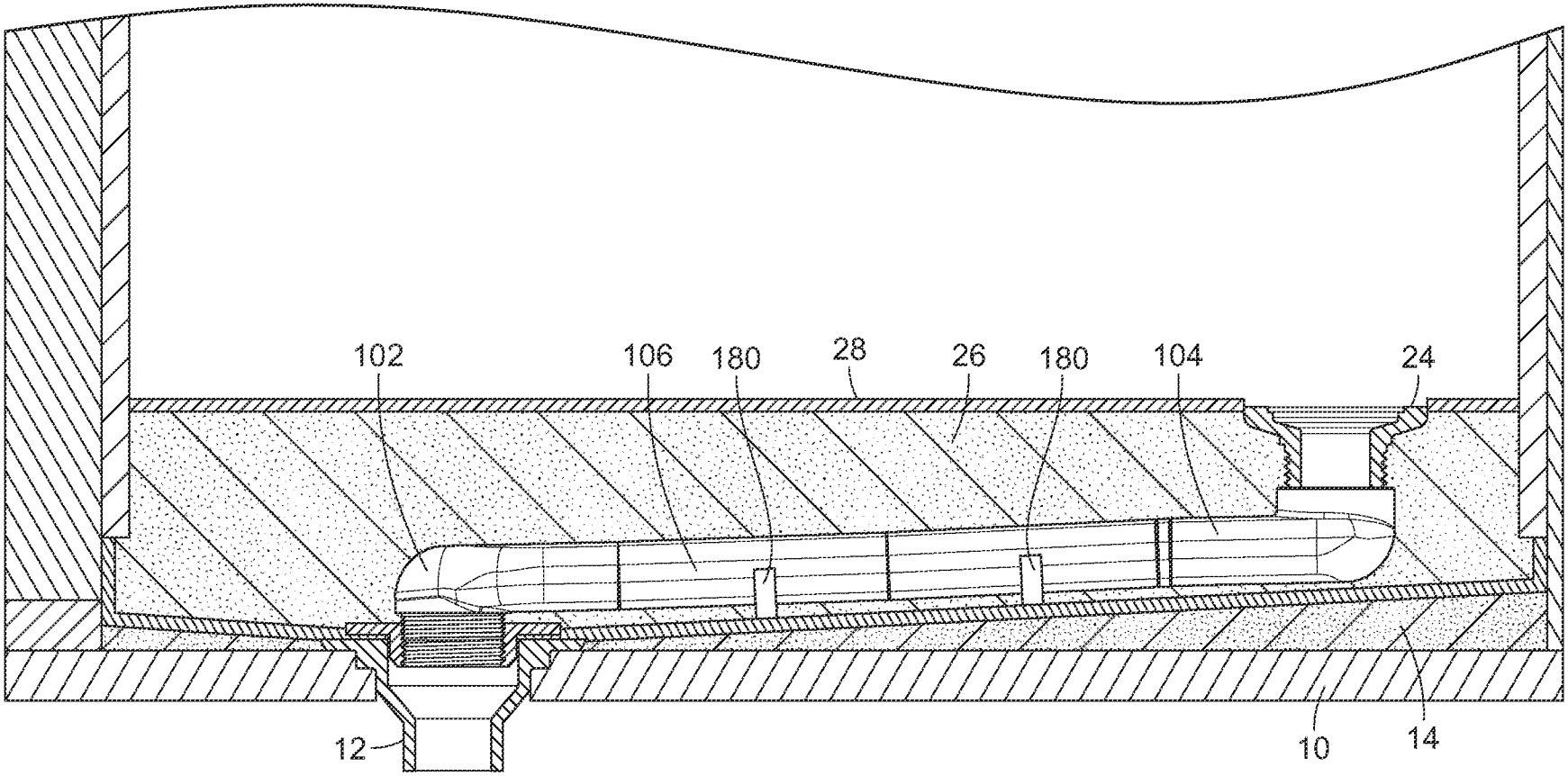

With reference now to FIG. 5, once the existing floor drain 12 and the new floor drain 24 have been connected to one another with the created extension pipe 106, and the extension pipe 106 and new floor drain 24 properly elevated using shims 180, the installer may then set the assembly 100 in mortar and place tiles 28 thereover, or whichever desired floor material or new shower or bathtub pan or the like to create the new floor 26 overlying the existing floor. Water will then drain and flow through the new drain 24, through the assembly 100 of the present invention, and into the existing floor drain 12 without the need to jackhammer through the concrete slab 10 to create a new floor drain through the existing floor. The existing subfloor and waterproof membrane, etc. can also be retained in place.

Figure 17:
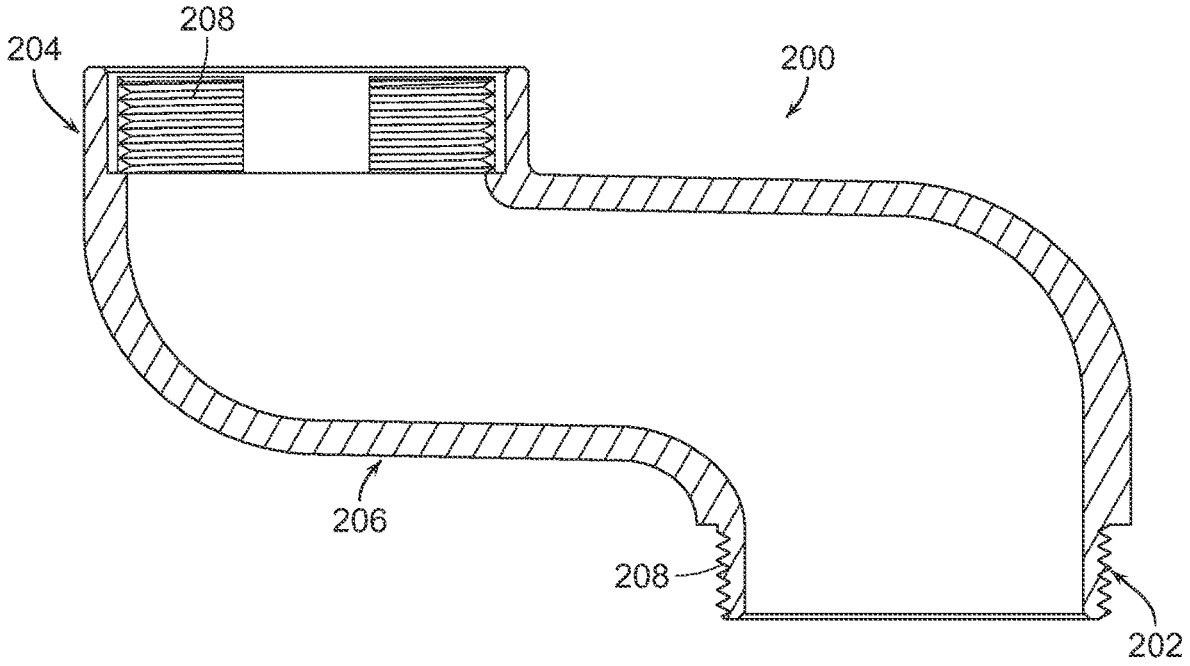
FIG. 17 is a cross-sectional view of a Z-shaped component for interconnecting drains, in accordance with the present invention.

With reference now to FIG. 17, when the existing drain 12 and the new drain 24 are to be closely spaced from one another, such as less than a foot apart from one another, or even only a few inches laterally spaced from one another, an assembly 200 of the present invention having a generally Z-shaped configuration may be utilized. A lower portion 202 of the assembly 200 can be coupled to the existing drain 12, such as by means of external threads 208. An upper portion 204 is attachable to the new drain 24, such as by means of internal threads 208. The tubing section therebetween, which is typically integrally formed with the lower 202 and upper 204 portions forms the extension pipe 206 which may only be several inches in length, such as four to six inches in overall length. This one piece unit has its lower end 202 attached to the existing drain 12 and rotated to the desired location on the new drain 24, which is attached to the upper portion 204, such as by means of threaded connection.

The present invention also contemplates use of a P trap access elbow. This would allow for the consumer or user to access the original P trap while using the system of the present invention. The P trap access elbow is a pipe that has a generally T-shaped configuration and gives access to the P trap. The end of the T-shaped elbow gives access through a dummy-type access drain that screws down from the top. It is threaded on the inner part of the T-shaped pipe to allow the dummy drain to be adjustable to finish the outer tile finish. The P trap access elbow of the present invention can also act as a typical drain for water flow, thus making it a two drain system. The generally opposite end of the T-shaped access elbow threads into the original drain. The elbow portion of the T-shaped access elbow, being the longer part of the "T" is connected to the drain system of the present invention, allowing for the new replacement of the newer drain to flow. The P trap elbow could be shaped and adaptable to the drain system of the present invention and also be able to thread into the original drain system for P trap cleaning and accessibility. This would allow for another drain to thread down into it from the top.

Figure 18:
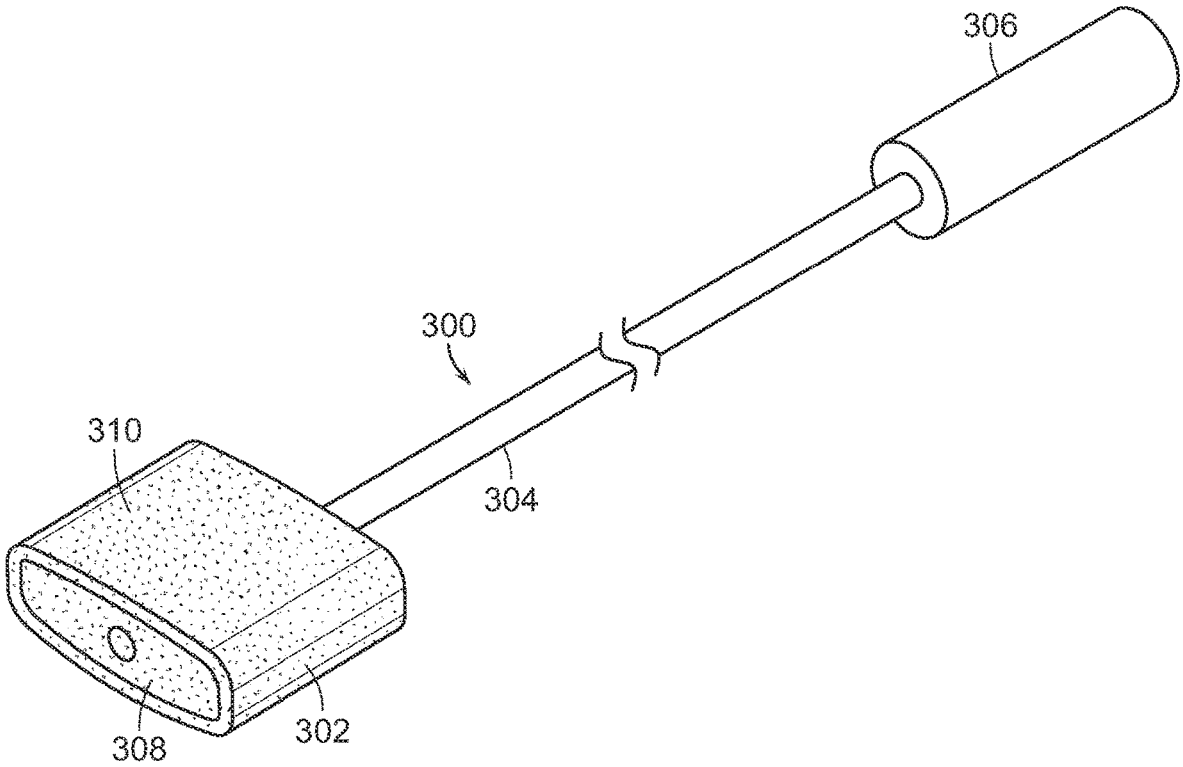
FIG. 18 is a perspective view of a drain cleaner for use in the present invention.

With reference now to FIG. 18, the present invention contemplates the use of a cleaning tool 300 for cleaning and clearing obstructions from the drain system 100 embodying the present invention. A cleaning brush 302 is attached to one end of a flexible rod 304 having a handle 306 at a generally opposite end thereof. The flexible rod 304 may be flexible like a fishing pole to allow flexibility while pushing the cleaning brush tip 302 from the new drain 24, into the second elbow fitting 104, extension pipe 106, second elbow fitting 102 and even to the existing drain 12. Depending upon the distance between the drains, or the desired extension of the tool 300 into the new drain assembly 100, it is contemplated that the rod 304 may be formed in multiple pieces which can be assembled together to make it longer when necessary. Preferably, the cleaning brush tip 302 has an inner sponge material 308 surrounded by a microfiber material 310, or scrubber material or the like, allowing it to clean the assembly 100 without marring or scarring the inside surface thereof. The handle 306 may be formed of a foam material enabling it to be more easily held onto while cleaning the drains.

Although several embodiments have been described in detail for purposes of illustration, various modifications may be made without departing from the scope and spirit of the invention. Accordingly, the invention is not to be limited, except as by the appended claims.

What is claimed is:

1. A method for interconnecting an existing floor drain having an underlying P-trap for a shower or bathtub to a new floor drain spaced laterally from the existing floor drain, comprising the steps of:

attaching a first elbow fitting to the existing floor drain directly above the underlying P-trap embedded in an existing floor of a room comprising the existing floor drain;

attaching a second elbow fitting to the laterally-spaced new floor drain;

attaching an extension pipe between the first and second elbow fittings to create a drain extension assembly such that a fluid pathway is formed between the new floor drain and the existing floor drain; and setting the drain extension assembly within a mortar forming a new floor of the room vertically overlaying and adjacent above the existing floor of the room for fluid drainage through the underlying P-trap.

2. The method of claim 1, wherein the first and second elbow fittings each have a first portion that is of a generally cylindrical configuration for attachment to the respective existing and new drains.

3. The method of claim 2, wherein the first and second elbow fittings each have a second portion, extending away from the first portion at an angle, that is of a reduced profile.

4. The method of claim 3, wherein the second portions of the first and second elbow fittings have a generally flat configuration at one surface thereof.

5. The method of claim 4, wherein the second portions of the first and second elbow fittings have a generally curved configuration at a surface generally opposite the flat surface.

6. The method of claim 1, wherein the extension pipe has a reduced profile.

7. The method of claim 6, wherein the extension pipe has a generally flat configuration on an upper surface thereof.

8. The method of claim 7, wherein the extension pipe has a generally curved lower surface to form a D-shaped cross-sectional area of the extension pipe.

9. The method of claim 6, wherein the extension pipe comprises interconnected multiple intermediate pipes and/or couplings.

10. The method of claim 9, wherein the extension pipe includes a curved intermediate pipe to create a bend in the extension pipe.

11. The method of claim 1, including the step of connecting the existing drain to spaced apart first and second new drains, wherein the extension pipe has a Y-shaped portion defining first and second branches fluidly connecting the first and second new drains to the existing drain.

12. The method of claim 1, including the step of coupling at least one shim to a lower portion of the extension pipe to create a desired slope between the new and existing drains.

13. The method of claim 12, including the step of coupling at least one U-shaped shim to the extension pipe.

14. The method of claim 13, including the step of attaching a flat shim to the at least one U-shaped shim to elevate at least a portion of the extension pipe.

15. A drain assembly for interconnecting an existing floor drain having an attached underlying P-trap for a shower or bathtub to a new floor drain spaced laterally from the existing floor drain, comprising a first elbow fitting attachable to the existing floor drain above the underlying P-trap;

a second elbow fitting attachable to the new floor drain to accommodate fluid drainage from the new drain;

an extension pipe between the first and second elbow fittings to create a drain extension assembly between the new drain and the existing floor drain attached to the underlying P-trap; and a new floor of a room overlaying an existing floor of the room with the underlying P-trap embedded in the existing floor of the room through which the existing drain extends to accommodate a fluid flow into the P-trap from the new floor drain, the new floor of the room comprising a mortar in which the drain extension assembly is embedded, wherein the new floor drain is disposed adjacent and open to an upper surface of the new floor of the room.

16. The drain assembly of claim 15, wherein the extension pipe comprises interconnected multiple intermediate pipes and/or couplings.

17. The drain assembly of claim 15, wherein the extension pipe includes a curved intermediate pipe to create a bend in the extension pipe.

18. The drain assembly of claim 15, wherein the extension pipe has a Y-shaped portion defining first and second branches fluidly connecting the first new drain and a second new drain to the existing drain.

19. The drain assembly of claim 15, including at least one shim connected to a lower portion of the extension pipe to create a desired slope between the new and existing drains.

20. The drain assembly of claim 15, wherein a first end of the extension pipe connects to the first elbow fitting and a second end of the extension pipe connects to the second elbow fitting such that the drain extension assembly forms a fluid pathway between the new floor drain and the existing floor drain.

21. The drain assembly of claim 20, wherein the first and second elbow fittings each have a first portion that is of a generally cylindrical configuration for attachment to the respective existing and new drains, and wherein the first and second elbow fittings each have a second portion extending away from the first portion at an angle that is of a reduced vertical profile.

22. The drain interconnection assembly of claim 20, wherein the extension pipe has a generally flat configuration on an upper surface and a generally curved lower surface to form a D-shaped cross-sectional area.

* * * * *